US008369768B2

(12) United States Patent
Thayer et al.

(10) Patent No.: US 8,369,768 B2
(45) Date of Patent: Feb. 5, 2013

(54) CLEANING BLADE PARAMETER ADJUSTMENT SYSTEM

(75) Inventors: Bruce Thayer, Spencerport, NY (US); Aaron Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 331 days.

(21) Appl. No.: 12/817,270

(22) Filed: Jun. 17, 2010

(65) Prior Publication Data

US 2011/0311286 A1 Dec. 22, 2011

(51) Int. Cl.
*G03G 21/00* (2006.01)

(52) U.S. Cl. ..... 399/350; 399/345

(58) Field of Classification Search ..... 399/71, 399/123, 350

See application file for complete search history.

(56) References Cited

U.S. PATENT DOCUMENTS

| | | | | |
|---|---|---|---|---|
| 2001/0055043 | A1* | 12/2001 | Wanibuchi et al. | 347/33 |
| 2002/0191523 | A1 | 12/2002 | Warmenhoven | |
| 2003/0127866 | A1* | 7/2003 | Martinez et al. | 292/216 |
| 2004/0005407 | A1* | 1/2004 | Takeuchi et al. | 427/240 |
| 2004/0253029 | A1* | 12/2004 | Shyu | 399/350 |
| 2005/0126889 | A1 | 6/2005 | Wiggins | |
| 2008/0061499 | A1 | 3/2008 | DeGruchy et al. | |
| 2009/0009573 | A1 | 1/2009 | Larson et al. | |
| 2009/0304406 | A1 | 12/2009 | Thayer et al. | |
| 2010/0054830 | A1* | 3/2010 | Thayer et al. | 399/350 |

FOREIGN PATENT DOCUMENTS

| | | | |
|---|---|---|---|
| JP | 01167872 | A * | 7/1989 |
| JP | 01167873 | A * | 7/1989 |
| JP | 2206554 | | 8/1990 |
| JP | 10024557 | | 1/1998 |
| JP | 2006317644 | A * | 11/2006 |
| JP | 2008030430 | A * | 2/2008 |
| KR | 20030021725 | | 3/2003 |

* cited by examiner

*Primary Examiner* — David Gray
*Assistant Examiner* — Tyler Hardman
(74) *Attorney, Agent, or Firm* — Gibb & Riley, LLC

(57) ABSTRACT

A cleaning blade assembly within a printing device is positioned to contact a surface to be cleaned. There is a first opening within the cleaning blade assembly and a first pin within the first opening. There is also a second opening within the cleaning blade assembly, and a second pin within the second opening. The first and second pins connect the cleaning blade assembly to the printing device. The first pin has a first cam surface that is rounded and is off-center with respect to the axis of the first pin. The cam surface is parallel to the axis of the first pin and is positioned within the first opening such that rotation of the first pin within the first opening causes the cleaning blade assembly to move in a direction perpendicular to the axis of the first pin.

17 Claims, 9 Drawing Sheets

CLEANING BLADE PARAMETER ADJUSTMENT SYSTEM

BACKGROUND AND SUMMARY

Embodiments herein generally relate to printing devices and more particularly to a system that adjusts the position of a cleaning blade within printing devices relative to the surface of a component that is being cleaned.

Cleaning blades are commonly used within printing devices to remove excess material from various surfaces, such as photoreceptor belts. Cleaning blades, whether interference or force loaded, have traditionally maintained a static position against the cleaning surface. The position of the blade is chosen to optimize cleaning latitude, filming control, photoreceptor wear, and blade life. These are often competing goals and all are impacted by variations in operating conditions (e.g., temperature, humidity, component age, job length, paper type, cleaning surface friction, environment contaminants, image density, and area coverage). Ideally, the cleaning blade critical parameters, blade load, and working angle, would be adjusted to compensate for movement of the optimum setting based on varying operating conditions.

Cleaning blades are sometimes located and supported on pairs of locator pins positioned at the ends of the blade holder. With embodiments herein, one or both of the locator pins has the ability to rotate off-center from the axis. This off-center rotation repositions the blade holder. By selection of the pins to be rotated and placing the pins within slots or circular holes, the blade can be rotated and translated relative to the cleaning surface. Through control of the locator pin rotation, the blade load and working angle can be adjusted as desired. When implemented in a system with operation sensors, this blade parameter adjustment mechanism can dynamically respond to changes in operating conditions to maintain optimum performance.

One exemplary printing device embodiment herein comprises a component that has a surface to be cleaned. A cleaning blade assembly is included within the printing device, and the cleaning blade assembly is positioned to contact the surface to be cleaned. There is a first opening within the cleaning blade assembly and a first pin within the first opening. In some embodiments this first opening can comprise a slot and in other embodiments, the slot can have an arc shape. There is also a second opening within the cleaning blade assembly, and a second pin within the second opening. The first and second pins connect the cleaning blade assembly to the printing device.

The first pin has a cam surface that is rounded and is off-center with respect to the axis of the first pin. The cam surface is parallel to the axis of the first pin and is positioned within the first opening, such that rotation of the first pin within the first opening causes the cleaning blade assembly to move in a direction perpendicular to (toward or away from) the axis of the first pin. This direction is an arc movement in some embodiments.

The cleaning blade assembly has a first end and a second end, and the second end of the cleaning blade assembly makes contact with the surface to be cleaned. The first opening is positioned closer to the first end of the cleaning blade assembly relative to the position of the second opening. In, other words, the first opening is positioned relatively closer to the first end of the cleaning blade assembly and the second opening is positioned relatively closer to the second end of the cleaning blade assembly.

With these relative positions of the first and second openings, the rotation of the first pin, and associated movement of the cleaning blade assembly with respect to the axis of the first pin, cause the cleaning blade assembly to rotate around the axis of the second pin. Thus, the rotation of the first pin within the first opening causes the second end of the cleaning blade assembly to move relative to (toward or away from) the surface to be cleaned.

Some embodiments can include an actuator that is connected to the first pin and that rotates the first pin. The rotation of the first pin within the first opening by the actuator therefore causes the cleaning blade assembly to move relative to the surface to be cleaned. Further, a controller is connected to the actuator, and the controller determines when the actuator rotates the first pin and how much the first pin should be rotated. The controller operates the actuator to move the cleaning blade assembly relative to the surface to be cleaned to maximize cleaning performance of the cleaning blade assembly on the surface to be cleaned.

In other embodiments, the positions of the first pin and the second pin can be switched. Therefore, in these embodiments, the cam surfaced first pin is closer to the second end of the cleaning blade assembly, relative to the second pin. In such embodiments, rotation of the first pin also causes the second end of the cleaning blade assembly to move relative to the surface to be cleaned; however, the geometry of the movement of the second end of the cleaning blade assembly is different, which can be useful for certain devices.

In further embodiments, both the first pin and the second pin can each have the cam surface that is rounded and is off-center with respect to the axis of the pin. In such embodiments, the two pins can be rotated independently (or in common) in order to achieve many different types of movement of the second end of the cleaning blade assembly with respect to the surface of the component to be cleaned.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
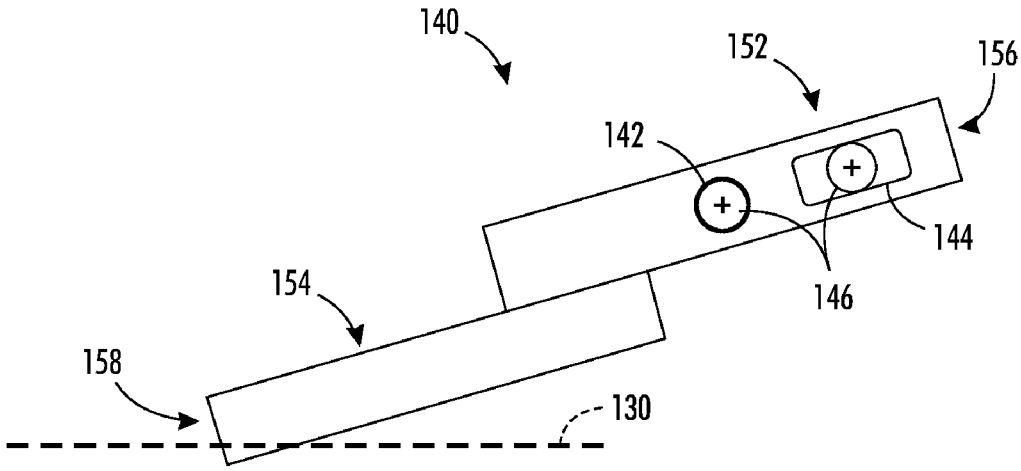
FIG. 1 is a side-view schematic diagram of a cleaning blade assembly and first end of cleaning blade assembly.

As mentioned above, the angle of the cleaning blade within printing devices would exhibit improved performance if it could be dynamically adjusted to account for different changing conditions. FIG. 1 shows a side view of a cleaning blade assembly 140. Each of the cleaning blades discussed herein includes a frame section (sometimes referred to herein as the "blade holder") 152 that connect to internal components of the printing device, and a flexible tip section 154 that contacts the surface to be cleaned (e.g., the "blade"). Items 156 and 158 are reference points that identify a nominal "first" end of the cleaning blade assembly (156) and a "second" end of the cleaning blade assembly (158), respectively, that are used herein merely as positional identifiers to describe the locations of various features of the embodiments herein.

Fixed locator pins 146 are positioned within first and second openings 142, 144. Note that the first opening 144 is a slotted opening 144, which aids in mounting the cleaning blade assembly 140 and accounts for manufacturing tolerance imperfections that may occur between the cleaning blade assembly 140, pins 146, and the mounting locations for the pins 146 within the printing device.

The locator pins 146 have sides that are symmetrical with respect to the axis of the pins 146 and do not allow off-axis rotation. Thus, the pins 146 constrain the blade in the horizontal and vertical dimensions. The locator pin 146 inserted into the slotted opening 144 constrains the blade 140 rotation about the locator pin 146 in the circular hole 142. Often, the locator pin 146 ends are tapered and the edges of the holes 142, 144 are chamfered to obtain easier insertion of the pins 146 into the holes 142, 146. In all examples shown, the relative positions of the holes and slots 144 could reverse.

Figure 2:
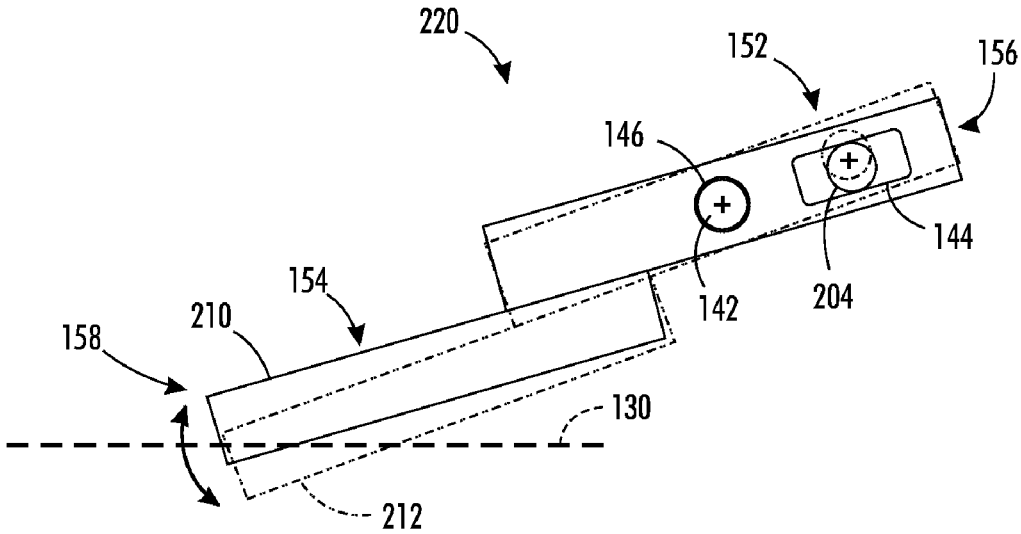
FIG. 2 is a side-view schematic diagram of a first end of cleaning blade assembly according to embodiments herein.

FIG. 2 shows the same blade holder 152 seen in FIG. 1, but the locator pin 204 inserted in the blade holder slot 144 rotates off axis of the pin center. The motion of the rotating, off-center locator pin 204 rotates the blade holder 152 around the fixed pin in the circular hole 142. The blade angle to the cleaning surface 130 can now be controlled by the rotation of the locator pin 204. The lighter, dashed outline cleaning blade and holder behind the blade 154 and holder 152 in FIG. 2 indicate the position of the blade after the off-center locator pin 204 has been rotated 180° from the position shown.

Figure 10:
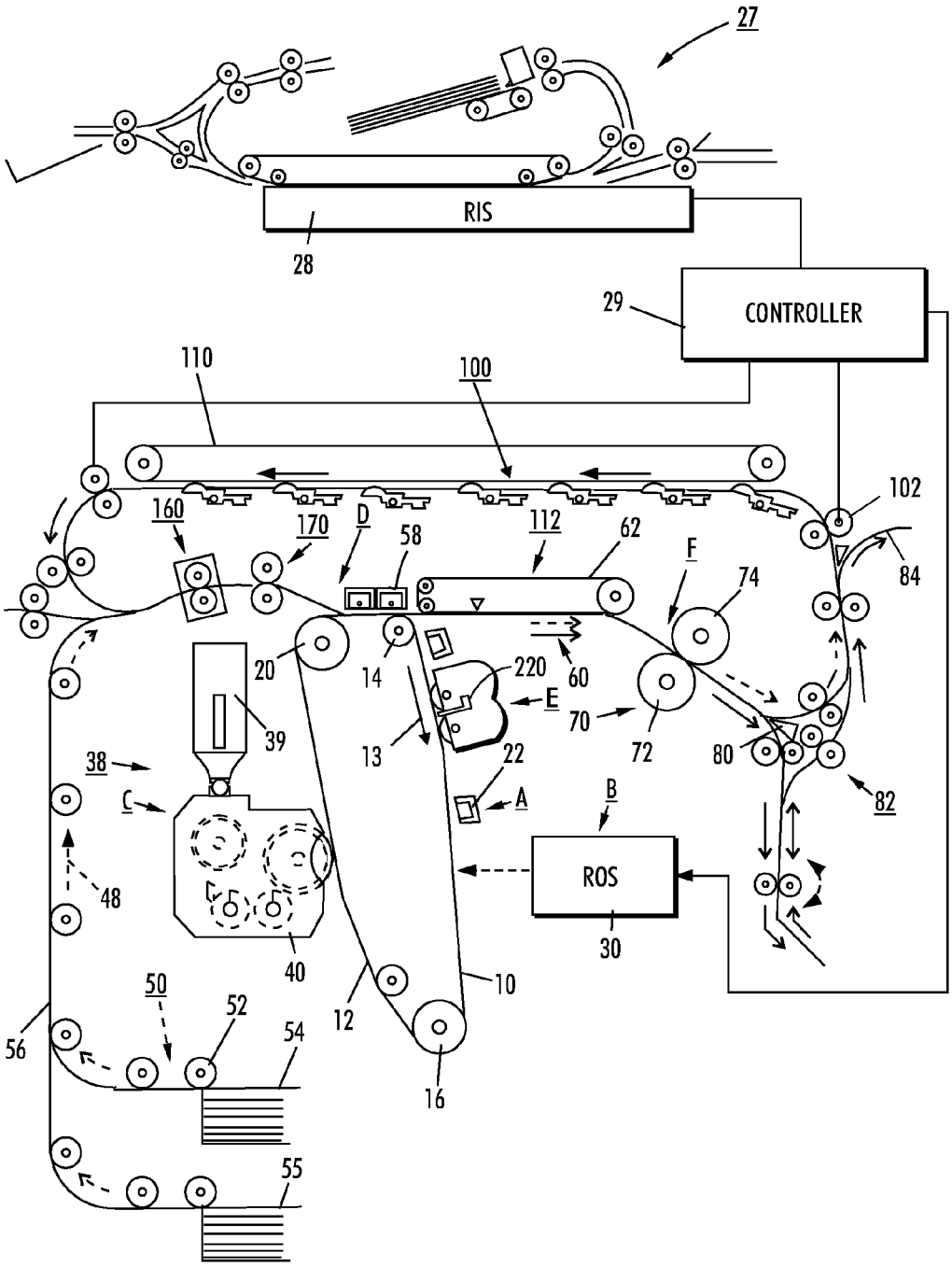
FIG. 10 is a side-view schematic diagram of a printing device using the cleaning blade according to embodiments herein.

In other words, the exemplary printing device embodiment shown in FIG. 2 comprises a component that has a surface to be cleaned 130. More of the details of the printing device are shown in FIG. 10, discussed below. A cleaning blade assembly 220 is included within the printing device, and the cleaning blade assembly 220 is positioned to contact the surface to be cleaned 130. There is a first opening 144 within the cleaning blade assembly 220, and a first pin within the first opening 144. In some embodiments, this first opening 144 can comprise a slot 144 and in other embodiments, the slot 144 can have an arc shape. There is also a second opening 142 within the cleaning blade assembly 220, and a second pin 146 within the second opening 142. The first and second pins 204, 146 connect the cleaning blade assembly 220 to the printing device.

The first pin 204 has a cam surface that is rounded and is off-center with respect to the axis of the first pin 204. Note that, in the drawings, the axis of the pins 146, 204 is shown as a cross symbol (+). As is well known to those ordinarily skilled in the art, with a cam there is more material on one longitudinal side of the longitudinal rotational axis of the cam, relative to the opposite longitudinal side (see FIGS. 11A-11C for more discussion of the cam pin 204).

The longitudinal outer cam surface is parallel to the longitudinal axis of the first pin 204 and is positioned within the first opening 144, such that rotation of the first pin 204 within the first opening 144 causes the cleaning blade assembly 220 to move in a direction perpendicular to (toward or away from) the longitudinal axis of the first pin 204. This direction is an arc movement in some embodiments because the blade assembly 220 rotates around the other pin 146.

The cleaning blade assembly 220 has a first end 156 and a second end 158, and the second end 158 of the cleaning blade assembly 220 makes contact with the surface to be cleaned 130. The first opening 144 is positioned closer to the first end 156 of the cleaning blade assembly 220 relative to the position of the second opening 142. In other words, the first opening 144 is positioned relatively closer to the first end 156 of the cleaning blade assembly 220 and the second opening 142 is positioned relatively closer to the second end 158 of the cleaning blade assembly 220.

With these relative positions of the first and second openings 144, 142, the rotation of the first pin 204, and associated movement of the cleaning blade assembly 220 with respect to the axis of the first pin 204, cause the cleaning blade assembly 220 to rotate around the axis of the second pin 146. Thus, the rotation of the first pin 204 within the first opening 144 causes the second end 158 of the cleaning blade assembly 220 to move relative to (toward or away from) the surface to be cleaned 130. Shown schematically in FIG. 2, item 210 shows the blade position when the pin 204 is in a first rotational position (0°) and item 212 shows (using dashed lines) the blade position when the pin 204 is in a second rotational position (180°).

As shown in FIG. 2, the first pin 204 within the blade holder 152 can be used to increase the angle of the blade to the cleaning surface 130; however, this can also undesirably increase the interference of the blade to the cleaning surface 130. "Blade interference" is a phrase which indicates the amount the cleaning blade flexible tip 154 would extend into the surface to be cleaned 130, if the flexible tip 154 did not flex when it contacts the surface 130. Increasing the blade interference to the cleaning surface 130 increases the blade load against the cleaning surface 130. Sometimes this is desirable, but often increasing the blade angle to the cleaning surface 130 with little or no increase in blade load is preferred.

One feature of embodiments herein that increases blade angle without significantly affecting blade load moves the off-center rotating locator pin 204 from the slotted opening 144 in FIG. 2 to the circular hole 142. This modification is shown in FIG. 3.

Figure 3:
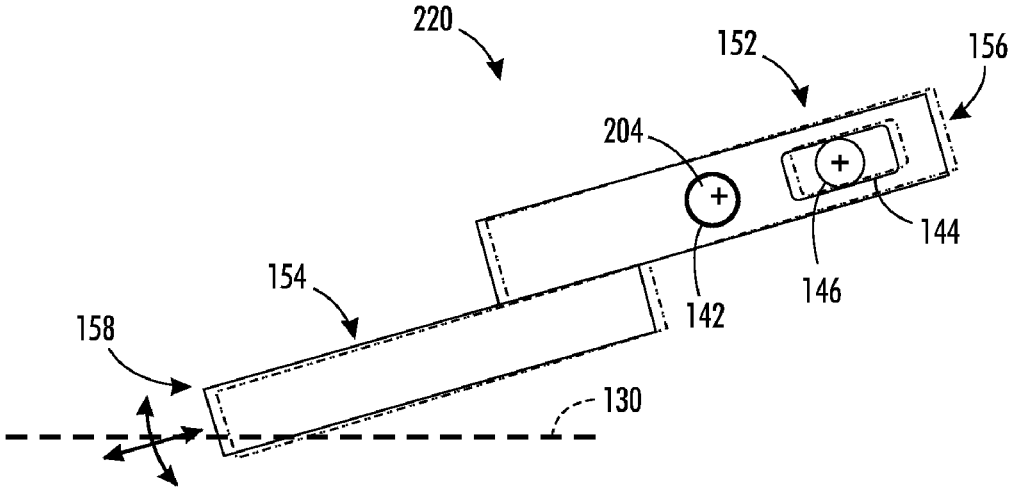
FIG. 3 is a side-view schematic diagram of a first end of cleaning blade assembly according to embodiments herein.

Thus, in the embodiment shown in FIG. 3, the positions of the first pin 204 and the second pin 146 can be switched. Therefore, in these embodiments, the cam surfaced first pin 204 is closer to the second end 158 of the cleaning blade assembly 220, relative to the second pin 146. In such embodiments, rotation of the first pin 204 also causes the second end 158 of the cleaning blade assembly 220 to move relative to the surface to be cleaned 130; however, the geometry of the movement of the second end 158 of the cleaning blade assembly 220 is different, which can reduce blade load.

In FIG. 3, the off-center rotating locator pin 204 in the circular hole 142 not only moves the blade holder 152 around the fixed locator pin 146 in the slotted opening 144, but also moves the blade toward and away from the cleaning surface 130. The position of the cam pin 204 within the second opening 142 increases the angle to the cleaning surface 130, but simultaneously reduces the interference (and blade load) to the cleaning surface 130 (as shown by the dashed line flexible tip 154 in FIG. 3). Through selection of appropriate dimensions (e.g., blade, holder, pin locations, pin rotation axis offset, pin rotation range) the cleaning blade assembly 220 design shown in FIG. 3 provides the desired adjustment in both blade load and working angle with rotation of the off-center locator pin 204.

The arrangement shown in FIG. 3 may be capable of moving between two desirable blade positions, but it may not be possible to find a desirable path between the positions. As an example, moving between the two positions shown in FIG. 3 may require that the blade interference to the cleaning surface 130 be increased beyond the two positions shown on its way to the final position. For many situations this is not a concern. In other cases it may be important. In the case where a continuous and smooth adjustment between to extreme positions is desired other designs may be more desirable, such as that shown in FIG. 4.

Figure 4:
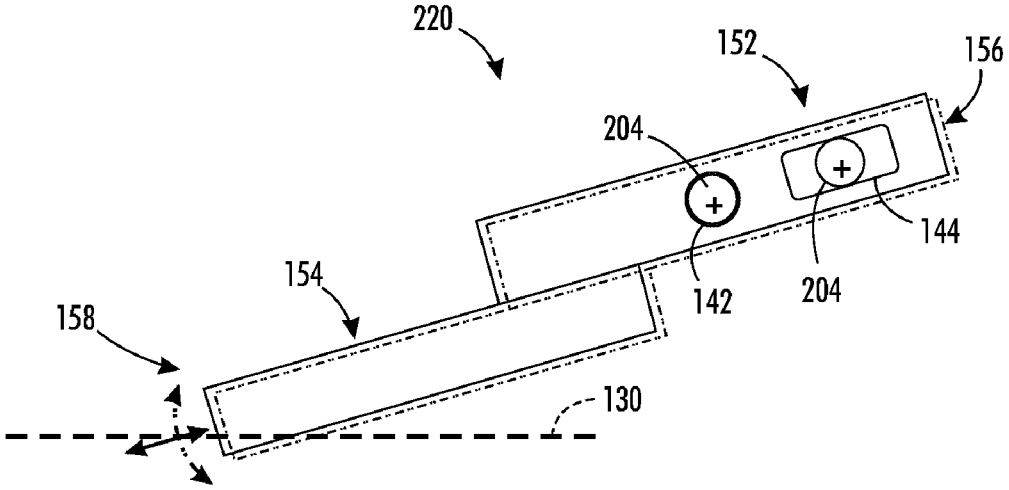
FIG. 4 is a side-view schematic diagram of a first end of cleaning blade assembly according to embodiments herein.

More specifically, FIG. 4 shows the blade tip 154 and blade holder 152 of the previous examples with off-center rotating locator pins 204 in both the circular 142 and slotted 144 openings.

Thus, in FIG. 4, both the first pin 204 and the second pin 204 can each have the cam surface that is rounded and is off-center with respect to the axis of the first pin 204. In such embodiments, the two pins 204 can be rotated independently (or in common) in order to achieve many different types of movement of the second end 158 of the cleaning blade assembly 220 with respect to the surface of the component to be cleaned 130.

This arrangement allows the independent adjustment of blade angle to the cleaning surface 130 and blade interference to the cleaning surface 130. As a first example, shown in FIG. 4, two identical rotating off-center pins could be rotated together with the same offset orientation (in phase). Rotation of the pins in this example causes the blade to move towards and away from the cleaning surface 130 in parallel positions at the same angle to the surface as shown by the dashed line positions of the cleaning blade assembly 220.

If one of the pins is rotated 180° from the position in FIG. 4 (180° out of phase) then the locator pin 204 in the circular hole 142 will modify the blade interference to the cleaning surface 130 and the rotation of the blade will be double the amount shown in FIG. 4. The amount of offset on the two locator pins 204 can be different in some embodiments. The rotation of the two locator pins 204 does not have to be in the same direction nor do they need to be rotated together or rotated for a full revolution. The two locator pins 204 could be rotated independently to better control the path of the blade as it moves through its range.

Figure 5:
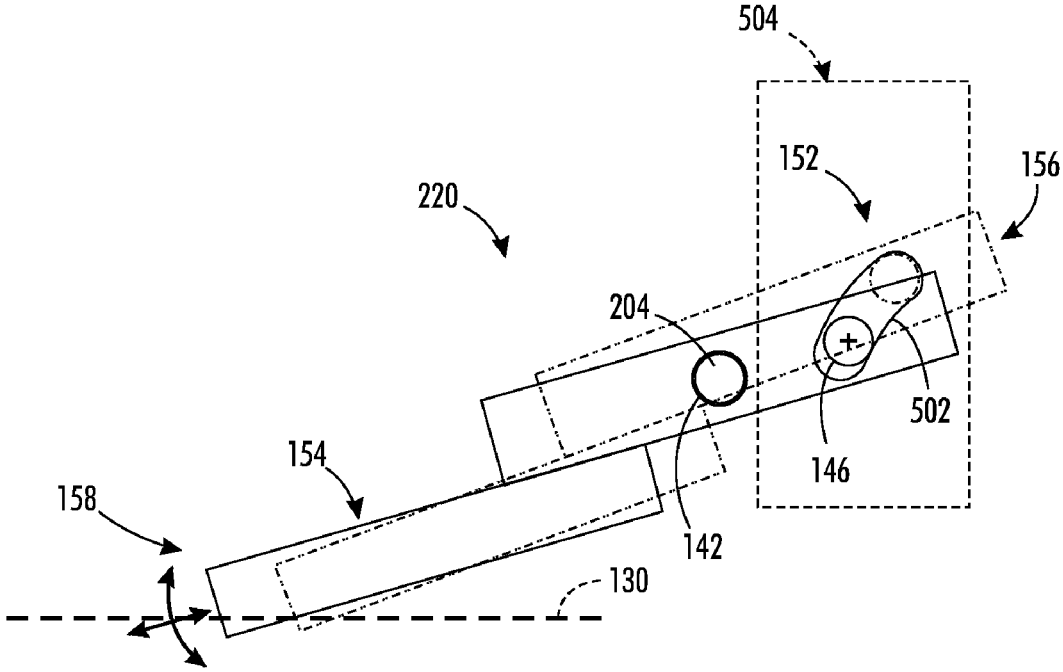
FIG. 5 is a side-view schematic diagram of a first end of cleaning blade assembly according to embodiments herein.

A variation of the arrangement shown in FIG. 3 is to orient the slot 144 so that as the rotating off-center locating pin moves the blade holder 152, the slot 144 can guide the blade tip in the desired path. The slot 144 need not be straight and can be curved (in an arc shape). Alternatively, as shown in FIG. 5, the slot 502 may be located on the printing device support frame and a fixed locator pin 146 can be located on the blade holder. In this case, the blade assembly motion is guided by both the off-center rotating locator pin 204 located in the second opening 142 and the fixed locator pin on the blade holder 146 sliding along the locator pin guide slot 502 on the support frame 504. The offset of the rotating locator pin 204 and the slot 502 length have been somewhat exaggerated in the drawings to illustrate the blade motions possible.

Figure 6A:
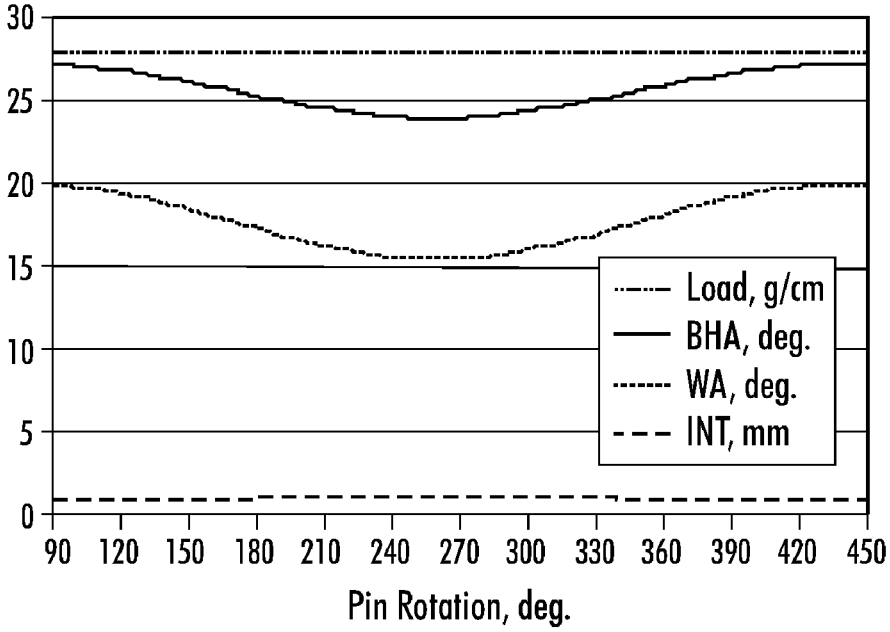
FIGS. 6A and 6B are charts illustrating the relationship between the blade holder angle, blade interference, blade load, and working angle.
Figure 6B:
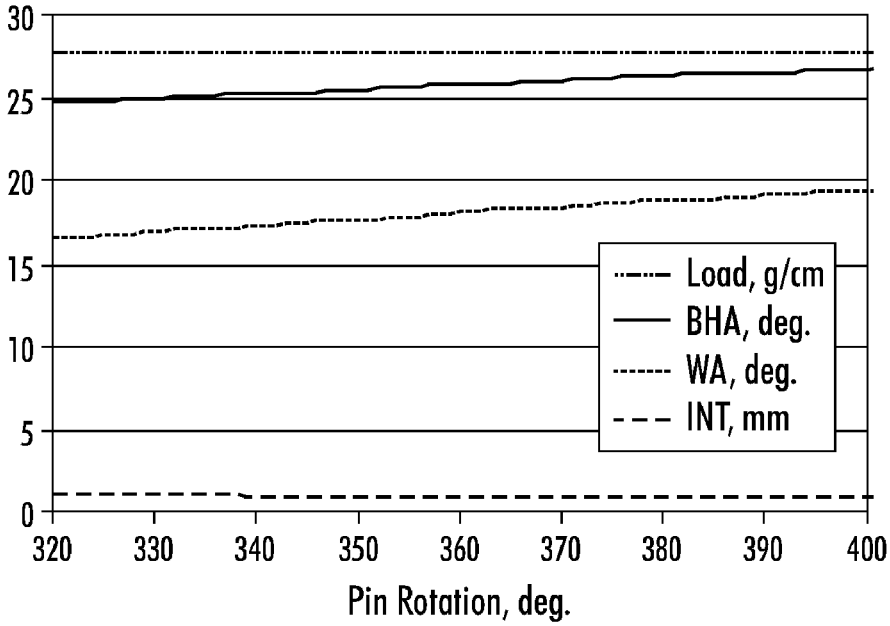

FIGS. 6A and 6B are graphs showing the relationship between the blade holder angle (BHA) to the surface 130, blade interference (INT) measure (in mm), blade load (Load) in g/cm, and working angle (WA) (the angle by which the blade tip 154 deflects with respect to the support frame 152) using the cleaning blade assembly shown in FIG. 5, where the goal is to adjust working angle while maintaining the blade load constant. The plot in FIG. 6A shows blade positions for a complete revolution of the off-center locator pin 204 between 90° and 450° locator pin 204 rotation.

Note that as shown in the top line of the chart in FIG. 6A (Load) the blade load remains constant at 30 g/cm, and the interference shown at the bottom line of the chart (INT) remains almost constant within the range between 0.9 mm and 1.1 mm. Therefore, as shown in FIG. 6A, the blade holder angle and the working angle can be changed to accommodate different cleaning efficiencies, without affecting interference or blade load.

FIG. 6B is similar to FIG. 6A, but shows a narrower pin rotation range of FIG. 6A between 320° and 400° locator pin 204 rotation. This portion of the pin rotation was selected for the blade adjustment design because it approximates a linear change in working angle with locator pin 204 rotation. The offset of the pin rotation axis from the center of the pin used in this example, is 0.5 mm.

Figure 7:
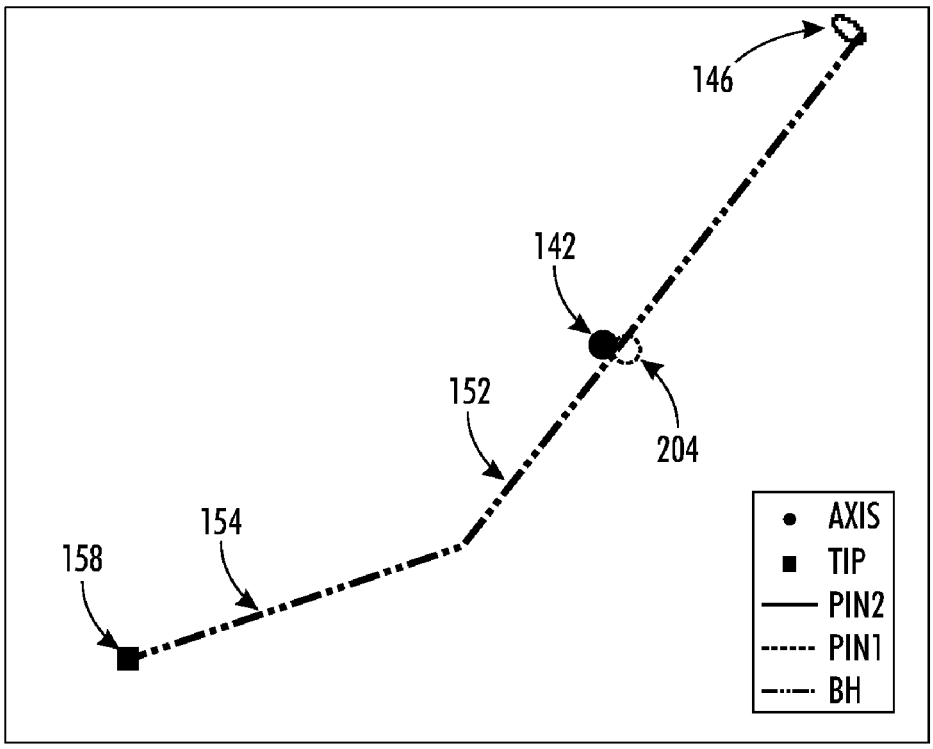
FIG. 7 is a schematic illustration of the axis, blade tip, pins, and blade holder (frame)

FIG. 7 is a schematic illustration of the axis (corresponding to pin 146), blade tip (corresponding to second end 158), pins (corresponding to pin 146 and 204), and blade holder (corresponding to blade holder 152), and blade (corresponding to blade 154) used in the position calculation results shown in FIGS. 6A and 6B. The square dot labeled tip 158 is the tip of the undeflected blade 154 at the interference position to create 30 g/cm blade load. The filled circular dot labeled axis is the position of the second opening 142. The open circular dot labeled pin1 is the center of the locator pin 204. The distance between the locator pin 204 axis dot and the center of the second opening 142 is 0.5 mm in this example. The elliptical line labeled pin2 is the path of the pin on the blade holder 152 as it follows the guide slot 502 on the support frame 152.

The shape of the guide slot 502, in the example shown in FIGS. 5-7, was determined by calculating the blade interference required at the cleaning surface 130 to maintain a constant blade load as the off-center locator pin 204 was rotated. The example given here was a blade contacting a drum photoreceptor; however, as would be understood by those ordinarily skilled in the art, the shape, length, and arc angle of the slot 502 would be different for different contact surfaces.

Off-center locator pin 204 rotation could be accomplished by a number of mechanical means, some of which are shown in FIGS. 8A-8E. Thus, some embodiments can include any form of actuator that can be connected to the first pin 204 and that rotates the first pin 204. The rotation of the first pin 204 within the first opening 144 by the actuator therefore causes the cleaning blade assembly 220 to move relative to the surface to be cleaned 130, as described above. Further, a controller (shown as element 29 and discussed below in FIG. 10) is connected to the actuator. The controller determines when the actuator rotates the first pin 204 and how much the first pin 204 should be rotated. The controller 29 operates the actuator to move the cleaning blade assembly 220 relative to the surface to be cleaned 130 to maximize cleaning performance of the cleaning blade assembly 220 on the surface to be cleaned 130.

Figure 8A:
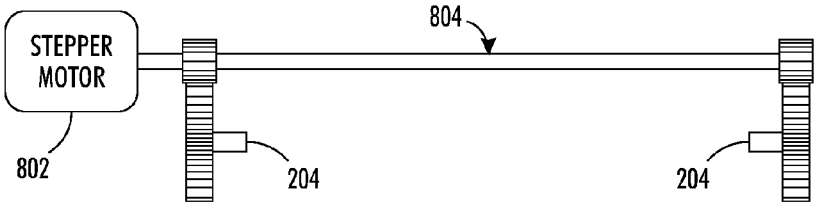
FIG. 8A-8E are side-view schematic diagrams of actuator devices used with cleaning blades according to embodiments herein.
Figure 8B:
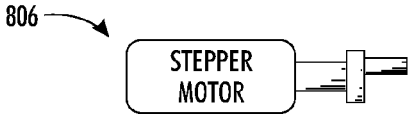
Figure 8C:
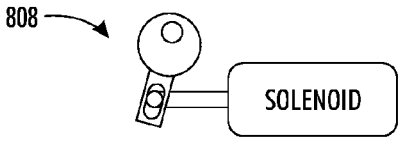
Figure 8D:
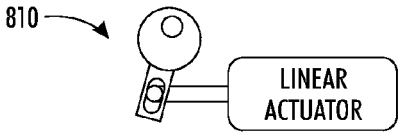

FIG. 8A illustrates a stepper motor 802 that is connected to one or more off-center locator pins 204 through, for example, a gear drive system with inboard and outboard coupling 804. While one type of gear drive system 804 is illustrated in FIG. 8A, those ordinarily skilled in the art would understand that any form of drive system (including, but not limited to belts, hydraulics, clutches, rollers, wheels, etc.) could be utilized to translate the movement of the motor 802 to the pins 204. As would be further understood by those ordinarily skilled in the art, if multiple pins 204 were utilized, such pins 204 could be driven using a common motor and common drive system, or could be independently driven and controlled using multiple motors, and/or multiple drive systems.

Figure 8E:
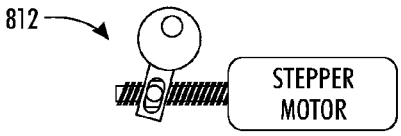

Further, FIGS. 8B-8E provide a non exhaustive list of some exemplary motors that could be utilized with embodiments herein. Such motors include a direct stepper motor drive 806 (FIG. 8B); a solenoid drive 808 (FIG. 8C); a linear actuator drive 810 (FIG. 8D); and a screw drive 812 (FIG. 8E). While some specific types of motors are mentioned above, those ordinarily skilled in the art would understand that any form of actuator/motor could be utilized with embodiments herein, and that the embodiments herein are not limited to the few examples that are shown in the attached drawings.

For cases where only two positions of the blade are desired, rotation of the off-center locator pins 204 could be accomplished with, for example, the solenoid 808. For continuous adjustment of the blade position, a stepper motor 806 or linear actuator 810 (e.g., voice-coil actuator typically used for acoustic speakers) could be used. The motor could directly rotate the pin or the pin could be rotated through an arrangement of gears or rotation of a screw. A shaft could be used to couple rotation of inboard and outboard locator pin gears and enable the use of only one motor. If separate motors are used for inboard and outboard locator pin rotations, then independent adjustments at the ends of the blades would be enabled. Such independent adjustments are useful for obtaining uniform end to end blade loading when part tolerances create misalignments or to compensate for non-uniform operating conditions.

Figure 9:
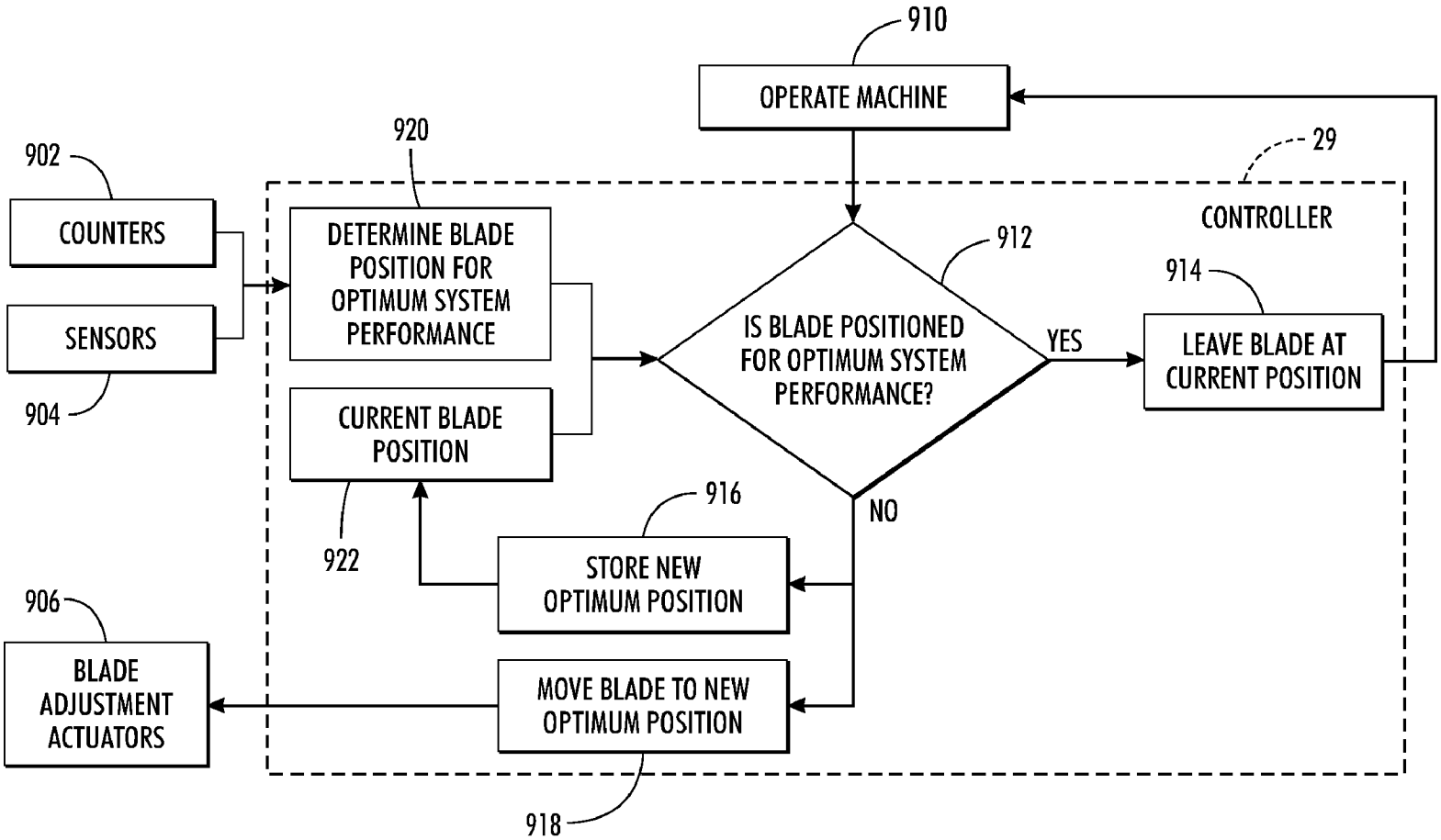
FIG. 9 is a schematic system and logic flow diagram according to embodiments herein.

FIG. 9 illustrates a portion of the system that can be used to control the blade adjustment actuators 906. The blade adjustment actuator mechanisms 906 (such as those discussed above and illustrated in FIGS. 8A-8E) are useful in combination with sensors 904 that provide operation information to a controller 29 that then processes the information to determine appropriate adjustments and provides a signal to the actuator 906 to make dynamic adjustments in response to changing operating conditions within the printing device. Various known methodologies exist for adjusting cleaner blade load. One example of the methodology for adjusting the cleaner blade load on a photoreceptor is discussed in U.S. Patent Publication 2009/0304406, the complete disclosure of which is incorporated herein by reference.

The sensors 904 may detect one or more of the following example operating conditions; temperature, relative humidity, component age, job length, paper type, environment contaminants, cleaning surface friction, cleaning blade strain, cleaning blade deflection, image density, print area coverage, etc. These operating conditions, alone or in combination, influence the desired performance of the cleaner blade assembly 220 relative to the following cleaning performance criteria; toner cleaning, additive cleaning, film cleaning, cleaning surface wear, and wear of the blade. Wear directly contributes to the usable life of the cleaning surface 130 and the blade 220. The controller 29 uses the operation condition information provided by the sensors 904 to select a cleaning blade operating position (blade holder angle and interference) that satisfy the cleaning performance criteria.

FIG. 9 shows a cleaning blade adjustment system and logic flow chart. The counters 902 and sensors 904 provide information to the controller 29 relative to the performance criteria discussed above. Item 910 illustrates the operation of the machine. During such operation, through direct measurements and empirically determined predictive equations, the controller 29 calculates the system state relative to the performance criteria and a cleaning blade position to optimize the performance criteria.

More specifically, item 920 determines the blade positioned for optimum system performance and item 922 determines the current blade position. If, in item 912, the optimum cleaning blade position is different than the current position, the controller 29 causes the cleaning blade adjustment actuators 906 to move the blade to the new optimum cleaning blade position as shown by item 918. Item 916 stores the new optimum position as the current blade position for item 922. If the optimum cleaning blade position is the same as the current blade position, the blade is not moved (as shown by item 914) and the machine continues operation at the current blade position. The controller 29 may monitor the performance state of the system on a continuous basis or on a periodic basis based on print count, cycle count or other relevant measure.

As an example, the adjustment of cleaning blade working angle can be made to increase photoreceptor abrasion and remove photoreceptor films. The cleaning blade working angle has been shown to be the largest contributor to photoreceptor wear. Photoreceptor wear is higher at high working angles and lower at low working angles. When photoreceptor films are present, the cleaning blade working angle can be increased to increase photoreceptor wear and reduce the film thickness to a level that does not cause print defects.

However, the working angle should not be left at the high setting after the film has been reduced, because the continued photoreceptor wear reduces the life of the photoreceptor. It is desirable to adjust the cleaning blade working angle to high levels when film thickness is high or when conditions that generate rapid film growth are present. When film thickness is acceptable or rapid film growth conditions are no longer present, the cleaning blade working angle should be returned to lower levels to extend photoreceptor life.

With embodiments herein, sensors 904 detect the photoreceptor film thickness either directly or through detection of print defects. Alternatively, sensors 904 could detect conditions that influence the rate of film growth, e.g., temperature, relative humidity, paper type, job length, component age, image density, print area coverage. The controller 29 uses the information provided by the sensors 904 to determine an appropriate blade working angle to prevent the film from exceeding the threshold thickness that creates print defects, but at the same time operating the cleaning blade assembly 220 at as low an angle as possible, consistent with good cleaning, to minimize photoreceptor wear.

The embodiments herein make various cleaning blade adjustments using the actuator 906 to adjust the working angle while maintaining a constant blade load using, for example, the methodology illustrated in FIGS. 6A-6B. The actuator 906 can similarly be used with the structures illustrated in FIGS. 5 and 7 to provide continuous adjustment of working angle with no change in blade load. The actuator 906 can also be used with the structure shown in FIG. 4 to providing continuous adjustment of working angle at constant blade load. The actuator 906 used with the structure shown in FIG. 3 is capable of moving the blade between high and low working angle positions with the same blade load, where the blade load is not held constant as the blade moves between the two positions.

The actuator 906 used in the structure shown in FIG. 2 can increase blade working angle, but only by also increasing blade load. This may be acceptable if high working angles are required for only a short period of time before the blade returns to normal operation at lower working angles. The cleaning blade assembly 220 may be held at the high working angle until the sensors 904 indicate that the film thickness has been reduced below the level causing defects, or if the information is available the blade can be operated for a fixed number of cycles at the high working angle to remove the film.

The various embodiments described herein have a relatively low cost. In addition, because the embodiments herein make use of the same type of mounting pin mechanism that is currently used as standard in many machines, the system impacts are minimized.

The word "printer" or "printing device" as used herein encompasses any apparatus, such as a digital copier, bookmaking machine, facsimile machine, multi-function machine, etc., which performs a print outputting function for any purpose. The embodiments herein specifically apply to any printing technology (xerographic, inkjet, dry ink, etc.). The details of printers, printing engines, etc., are well-known by those ordinarily skilled in the art and are discussed in, for example, U.S. Patent Publication 2008/0061499, the complete disclosure of which is fully incorporated herein by reference.

While FIG. 10 describes an electrophotographic printing machine, those ordinarily skilled in the art would understand that the present embodiments are equally applicable to any form of printing machine, whether now known or developed in the future. For example, the embodiments herein are especially applicable to direct printing architectures including inkjet-based printing, ribbon-based printing, etching, etc. For a full discussion of one example of direct printing architectures see U.S. Patent Publication Number 2009/0009573 and the patents and publications listed therein (the complete disclosures of which are incorporated herein by reference).

For example, FIG. 10 schematically depicts an electrophotographic printing machine that is similar to one described in U.S. Patent Publication 2008/0061499. It will become evident from the following discussion that the present embodiments may be employed in a wide variety of devices and are not specifically limited in its application to the particular embodiment depicted in FIG. 10.

FIG. 10 schematically depicts an electrophotographic printing machine incorporating the features of the present disclosure therein. FIG. 10 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 10 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, a raster output scanner (ROS), indicated generally by reference numeral 30. Preferably, ESS 29 is a self-contained, dedicated minicomputer. The image signals transmitted to ESS 29 may originate from a RIS as described above or from a computer through a network connection input/output—thereby enabling the electrophotographic printing machine to serve as a remotely located printer for one or more computers. Alternatively, the printer may serve as a dedicated printer for a high-speed computer connected to the input/output 112.

The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by raster basis.

After the electrostatic latent image has been recorded on photoconductive surface 12, belt 10 advances the latent image to a development station C, where used toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser that contains marking material and is sometimes referred to herein as a marking material supply container, indicated generally by the reference numeral 39, dispenses toner particles into developer housing 40 of developer unit 38.

With continued reference to FIG. 10, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a feed rolls 52 contacting the uppermost sheet of stacks 54 and 55, respectively. Feed roll 52 rotates to advance the uppermost sheet from stack 54 into vertical transport 56. Vertical transport 56 directs the advancing sheet 48 of support material into pre-registration device 160 which in conjunction with stalled roll registration mechanism 170 moves a now registered sheet 48 past image transfer station D to receive an image from photoreceptor 10 in a timed sequence so that the toner powder image formed thereon contacts the advancing sheet 48 at transfer station D. The vertical transport 56 can comprise a vacuum belt. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade assembly 220 to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors 904 or switches may be utilized to keep track of the position of the document and the copy sheets. Further, the controller 29 includes a computer readable storage medium that stores instructions that are executed by the controller to allow the printing device to perform the various functions that are described herein.

Figure 11A:
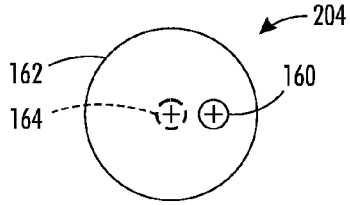
FIGS. 11A-11C are top-view, side-view, and perspective view schematic diagram of an off-center pin according to embodiments herein.
Figure 11B:
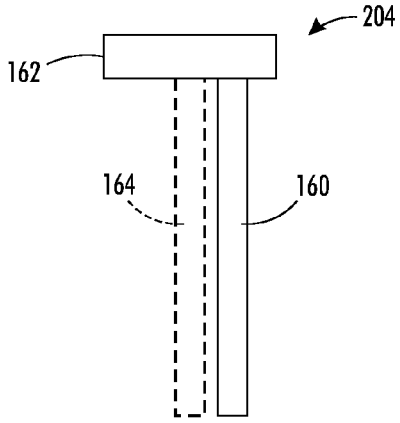
Figure 11C:
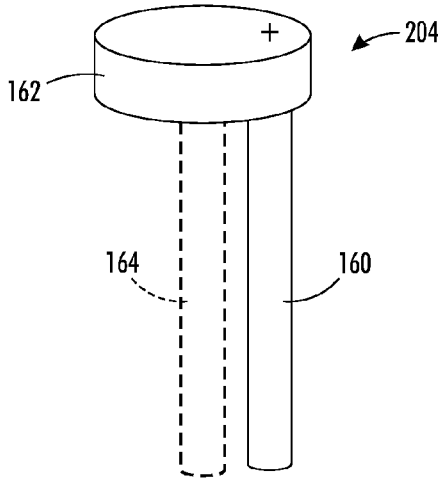

FIGS. 11A-11C illustrate the off-centered cam pin 204 in top-view (FIG. 11A); side-view (FIG. 11B); and perspective view (FIG. 11C). In FIGS. 11A-11C item 160 represents the axis of the pin 204, item 162 represents the top of the pin 204, and item 164 represents a location where the axis of the pin 204 would be if the axis 160 were not off-center. As is shown in FIGS. 11A-11C, when the pin 204 rotates the top (or cam) portion 162 of the pin 204 will move from side to side, if the axis 160 of the pin 204 is held in a fixed location (by the frame of the printing apparatus). When the top 160 moves from side to side as the pin 204 rotates, the top 160 presses against the sides of the openings 144, 142 to move the cleaning blade frame 152 from side to side relative to the axis 160 (which in turn causes the entire cleaning blade assembly 220 to move as described above).

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. For example, the printing devices could comprise powder toner based printers, inkjet printers, dry ink printers, etc. Thus, the embodiments herein could also apply to a cleaning/metering blade use on the drum maintenance system of a solid ink jet (SIJ) printer. The details of printers, printing engines, etc., are well-known by those ordinarily skilled in the art. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A cleaning blade assembly for use within a printing device, said cleaning blade assembly comprising:

a first opening within said cleaning blade assembly;

a first pin within said first opening, said first pin connecting said cleaning blade assembly to said printing device;

a second opening within said cleaning blade assembly; and a second pin within said second opening, said second pin connecting said cleaning blade assembly to said printing device, said first pin comprising a first axis and a first cam surface that is rounded and is off-center with respect to said first axis, said first cam surface being parallel to said first axis and being positioned within said first opening, rotation of said first pin within said first opening causing said cleaning blade assembly to move in a first direction perpendicular to said first axis, said second pin comprising a second axis and a second cam surface that is rounded and is off-center with respect to said second axis, said second cam surface being parallel to said second axis and being positioned within said second opening, rotation of said second pin within said second opening causing said cleaning blade assembly to move in a second direction perpendicular to said second axis, and said first direction and said second direction comprising an arc.

2. The cleaning blade assembly according to claim 1, said rotation of said first pin causing said cleaning blade assembly to rotate around said second axis and said rotation of said second pin causing said cleaning blade assembly to rotate around said first axis.

3. The cleaning blade assembly according to claim 1, further comprising an actuator connected to said first pin, said actuator rotating said first pin.

4. The cleaning blade assembly according to claim 1, said cleaning blade assembly having a first end and a second end, said second end of said cleaning blade assembly making contact with a surface to be cleaned within said printing device, said first opening being positioned closer to said first end of said cleaning blade assembly relative to a position of said second opening, and said rotation of said first pin within said first opening causing said second end of said cleaning blade assembly to move relative to said surface to be cleaned.

5. A cleaning blade assembly for use within a printing device, said cleaning blade assembly comprising:

a first opening within said cleaning blade assembly;

a first pin within said first opening, said first pin connecting said cleaning blade assembly to said printing device;

a second opening within said cleaning blade assembly; and a second pin within said second opening, said second pin connecting said cleaning blade assembly to said printing device, said first pin comprising a first axis and a first cam surface that is rounded and is off-center with respect to said first axis, said first cam surface being parallel to said first axis and being positioned within said first opening, rotation of said first pin within said first opening causing said cleaning blade assembly to move in a first direction perpendicular to said first axis, said second pin comprising a second axis and a second cam surface that is rounded and is off-center with respect to said second axis, said second cam surface being parallel to said second axis and being positioned within said second opening, and rotation of said second pin within said second opening causing said cleaning blade assembly to move in a second direction perpendicular to said second axis, said rotation of said first pin causing said cleaning blade assembly to rotate around said second pin, and said rotation of said second pin causing said cleaning blade assembly to rotate around said first pin.

6. The cleaning blade assembly according to claim 5, further comprising at least one actuator connected to said first pin and said second pin, said actuator rotating said first pin and said second pin.

7. The cleaning blade assembly according to claim 5, said cleaning blade assembly having a first end and a second end, said second end of said cleaning blade assembly making contact with a surface to be cleaned within said printing device, said first opening being positioned closer to said first end of said cleaning blade assembly relative to a position of said second opening, said rotation of said first pin within said first opening causing said second end of said cleaning blade assembly to move relative to said surface to be cleaned, and said rotation of said second pin within said second opening causing said second end of said cleaning blade assembly to move relative to said surface to be cleaned.

8. The cleaning blade assembly according to claim 5, said first direction and said second direction comprising an arc.

9. A cleaning blade assembly for use within a printing device, said cleaning blade assembly comprising:

a slotted first opening within said printing device, said first opening having an arc shape;

a first pin fixed to said cleaning blade assembly and within said first opening, said first pin connecting said cleaning blade assembly to said printing device;

a second opening within said cleaning blade assembly; and a second pin within said second opening, said second pin connecting said cleaning blade assembly to said printing device, said first pin comprising a first axis and a first cam surface that is rounded, said first cam surface being parallel to said first axis and being positioned within said first opening, said second pin comprising a second axis and a second cam surface that is rounded and is off-center with respect to said second axis, said second cam surface being parallel to said second axis and being positioned within said second opening, and rotation of said second pin within said second opening causing said cleaning blade assembly to move in a direction perpendicular to said second axis.

10. The cleaning blade assembly according to claim 9, said rotation of said second pin causing said cleaning blade assembly to rotate around said first axis and said first pin to slide in said first opening.

11. The cleaning blade assembly according to claim 9, further comprising at least one actuator connected to said first pin, said actuator rotating said first pin.

12. The cleaning blade assembly according to claim 9, said cleaning blade assembly having a first end and a second end, said second end of said cleaning blade assembly making contact with a surface to be cleaned within said printing device, said first opening being positioned closer to said first end of said cleaning blade assembly relative to a position of said second opening, said rotation of said second pin within said second opening causing said second end of said cleaning blade assembly to move relative to said surface to be cleaned.

13. The cleaning blade assembly according to claim 9, said first direction and said second direction comprising an arc.

14. A printing device comprising:

a component within said printing device, said component having a surface to be cleaned;

a cleaning blade assembly within said printing device, said cleaning blade assembly being positioned to contact said surface to be cleaned:

a first opening within said cleaning blade assembly;

a first pin within said first opening, said first pin connecting said cleaning blade assembly to said printing device;

an actuator connected to said first pin, said actuator rotating said first pin;

a controller connected to said actuator, said controller controlling when said actuator rotates said first pin;

a second opening within said cleaning blade assembly; and a second pin within said second opening, said second pin connecting said cleaning blade assembly to said printing device, said first pin comprising a first axis and a first cam surface that is rounded and is off-center with respect to said first axis, said first cam surface being parallel to said first axis and being positioned within said first opening, rotation of said first pin within said first opening by said actuator causing said cleaning blade assembly to move in a first direction perpendicular to said first axis, said second pin comprising a second axis and a second cam surface that is rounded and is off-center with respect to said second axis, said second cam surface being parallel to said second axis and being positioned within said second opening, rotation of said second pin within said second opening causing said cleaning blade assembly to move in a second direction perpendicular to said second axis, said first direction and said second direction comprising an arc, said rotation of said first pin within said first opening by said actuator causing said cleaning blade assembly to move relative to said surface to be cleaned, said controller operating said actuator to move said cleaning blade assembly relative to said surface to be cleaned.

15. The printing device according to claim 14, said rotation of said first pin causing said cleaning blade assembly to rotate around said second axis and said rotation of said second pin causing said cleaning blade assembly to rotate around said first axis.

16. The printing device according to claim 14, said cleaning blade assembly having a first end and a second end, said second end of said cleaning blade assembly making contact with said surface to be cleaned, said first opening being positioned closer to said first end of said cleaning blade assembly relative to a position of said second opening, and said rotation of said first pin within said first opening by said actuator causing said second end of said cleaning blade assembly to move relative to said surface to be cleaned.

17. The printing device according to claim 14, said printing device comprising one of a xerographic and electrostatic printing device.

* * * * *